US008960675B1

(12) United States Patent
Breslin

(10) Patent No.: US 8,960,675 B1
(45) Date of Patent: Feb. 24, 2015

(54) GAME USING IMAGES PRODUCED BY WETTING MEDIUM

(71) Applicant: Michael K. Breslin, Mill Valley, CA (US)

(72) Inventor: Michael K. Breslin, Mill Valley, CA (US)

( * ) Notice: Subject to any disclaimer, the term of this patent is extended or adjusted under 35 U.S.C. 154(b) by 30 days.

(21) Appl. No.: 13/724,838

(22) Filed: Dec. 21, 2012

(51) Int. Cl.
*A63F 3/00* (2006.01)
*A63F 1/02* (2006.01)

(52) U.S. Cl.
CPC ..... *A63F 1/02* (2013.01)
USPC ..... 273/249; 273/292

(58) Field of Classification Search
USPC ..... 273/292, 249
See application file for complete search history.

(56) References Cited

U.S. PATENT DOCUMENTS 1,950,649 A 3/1934 Bauer
3,454,344 A * 7/1969 Ryan et al. ..... 118/267
4,124,214 A * 11/1978 Pavis ..... 273/249
4,139,965 A * 2/1979 Curry et al. ..... 434/84
4,216,594 A 8/1980 Farley
4,684,135 A 8/1987 Bouchal
5,163,846 A 11/1992 Lee
5,213,505 A 5/1993 Laipply
5,288,084 A 2/1994 Miller
5,364,470 A * 11/1994 Greenberg ..... 118/500
7,798,907 B2 9/2010 Piccionelli et al.
2007/0231775 A1 10/2007 Wagner
2009/0014955 A1 1/2009 Hindermann
2012/0077152 A1 * 3/2012 Saha ..... 434/81

* cited by examiner

*Primary Examiner* — Michael Dennis
(74) *Attorney, Agent, or Firm* — David Pressman

(57) ABSTRACT

A game for creating and enlivening discussions between two or more people based upon images produced using liquid drops on a semi-absorbent surface. A few drops of liquid are randomly applied to a surface such as paper that has been treated to render a significant color change due to the reaction of the constituents of the liquid. The paper can be folded or twisted to enhance spreading of the liquid and absorption of the liquid into the paper and create a somewhat symmetrical image on the surface. The image thus formed is then used within the game. The game is then played according to the guidelines, if any, chosen by the participants before beginning.

19 Claims, 7 Drawing Sheets

GAME USING IMAGES PRODUCED BY WETTING MEDIUM

BACKGROUND

Prior Art

There have been a myriad of games created for the purpose of increasing social interaction between two or more people. Such games usually include many different kinds of game elements, such as a game board, cards, preselected answers, tokens, and apparatus of chance, such as dice or a spinning wheel. There are also games that employ lights, chemicals, or dyes to allow the player to reveal or create images. Games have been created specifically to involve the consumption of beverages, such as those often played in young social clubs, such as college fraternities and sororities. More often than not, all such games have a goal of winning a competition or passing a test to gain points or the approval or praise of others. Many such games include a rule that requires a player must consume a beverage as a penalty or reward, which can lead to inebriation if alcoholic beverages are involved.

Proposals have been made in the past to provide games and investigative devices which involved the application of liquids to surfaces sensitive to water, paints, inks, liquids with various pH qualities or pressure. There have also been games that are aimed at psychology and interpretation.

These games have many drawbacks, including the possible loss of the tokens, cards, or specialty chemicals, dyes, dice, or a spinning wheel. They also usually have judgments on moves, suggestions or interpretations and, very commonly, winners and losers, all of which can create a tense situation of competition rather than a relaxed interaction. The games can be large, unwieldy, take too long to explain, grasp, and play. Often an experienced player has an advantage over a less experienced player, thus creating unfairness and possibly frustration.

The following is a tabulation of some prior art that presently appears relevant to this field and that of the present developments:

| U.S. Patents | | | |
|---|---|---|---|
| Pat. No. | Kind Code | Issue Date | Patentee |
| 1,950,649 | B1 | 1934, Mar. 13 | Bauer |
| 3,454,344 | B1 | 1969, Jul. 8 | Ryan |
| 4,124,214 | B1 | 1978, Nov. 7 | Pavis |
| 4,139,965 | B1 | 1979, Feb. 20 | Currey et al. |
| 4,216,594 | B1 | 1980, Aug. 12 | Farley |
| 4,684,135 | B1 | 1987, Aug. 04 | Bouchal |
| 5,163,846 | B1 | 1992, Nov. 17 | Lee |
| 5,213,505 | B1 | 1993, May 25 | Laipply |
| 5,288,084 | B1 | 1994, Feb. 22 | Miller |
| 7,798,907 | B2 | 2010, Sep. 21 | Piccionelli, et al. |
| U.S. Published Patent Applications: | | | |
| Publication Nr. | Kind Code | Publ. Date | Applicant |
| US 2007/0231775 | A1 | 2007, Oct. 4 | Wagner |
| US 2009/0014955 | A1 | 2009, Jan. 15 | Hindermann |

For the purpose of this disclosure these patents and patent application publications, discussed infra, are incorporated by reference therein as if fully set forth.

Wagner shows an interpretive art workbook consisting of a book of multiple pages with a pre-printed or pre-drawn free-form line drawing on each page. The user is to make a complete drawing using the free-form line drawing as part of the final drawing. This type of apparatus requires a free-form line drawing and a method of deliberately drawing an image to include the free-form line drawing.

Hinderman shows a method of directing personal actualization using a plurality of preprinted cards with single or multiple words on each card. The player then creates a story from the words on the cards. This interpretive game requires cards with words thereon.

Bauer shows a method and apparatus to create a colorgram. It involves folding paper in half that has requires paints of different colors applied to one side of a median and folding at the preprinted median.

Ryan shows games employing a writing medium coated with a pH-sensitive indicator dye to record drawings, impacts, fingerprints, and writings. Said dye is of a color on one side of its shift range and turns to another color on the other side of its pH shift range. Ryan requires a writing medium composed of a material, such as a wax crayon, that would coat the paper and prevent the color change caused by the shift of pH to the other side of said dye's pH shift where the crayon has been used, causing writing to appear in the original color of the paper.

Pavis shows an interpretive game that necessitates asking questions and then comparing the response to existing responses and judging what value it is worth and thereby determining which player scores highest or how a player moves around a game board.

Curry shows a device using coated paper and a chemical reactive marker that requires a hollow housing with a surface that at least a partially transmits light and a light source therein to shine through the surface to create an image.

Farley shows a psychotherapeutic testing game that requires a plurality of cards, movable game pieces, a playing board, a tester a chance selection device.

Bouchal shows a story-telling game that requires planar members (e.g. story board, playing board), preprinted pictorial illustrations (e.g. cards) with legends and a means to randomly determine certain characteristics (e.g. dice). The players develop stories using these items according to rules of the game.

Lee shows a toy using water to cause images to appear on paper. The paper is required to be placed in a frame and a cylindrical water pen closed at one end and open at the other is used to create an image or write on the paper. He also shows games that employ multi-layered coatings on a sheet that are opaque when dry and transparent when wet to create an image using water that disappears as the top surface dries.

Laipply shows a variable color matrix device that uses a honeycomb constructed out of adjacent, transparent colorant receiving wells open on one end and closed on the other. It employs light-transmitting colored fluids to create patterns in the honeycomb of wells. Also showed is a process for producing designs using light-transmitting colorants and a multiple of wells that receive the fluids.

Miller shows an interpretive game that employs objects, a tactile interpreter, a plurality of geometric members, writing instrument, sketch web, a judge, a bag member and several steps to create a drawing of what a player describes as the object he is feeling.

Piccionelli et al. show a game using water reactive paper to be a target located in a toilet or urinal. It is used as a toilet-training device for young boys or can be used by adults when a photo of a co-worker, ex-spouse or roommate is employed as the target. The game inherently includes possible consequences incurred if the person in the photograph happens to use the same facility.

Also of relevance is an age-old game of producing images on paper by splattering ink, paint, or other liquid dye onto untreated paper and folding the paper. During the nineteenth century a game called "Blotto" was played by creating ink-blots or purchasing them and then creating stories or poems about the interpretations of them. Rorschach patterns, also created through ink blots, have been used in psychological analysis for decades.

SUMMARY

In accordance with one embodiment a game or activity is conducted by providing a specially treated paper that is randomly wetted with a liquid, such as a beverage being consumed by at least one player, to produce a unique image that will not disappear after the liquid dries. The paper is treated with at least one reactive chemical that will cause the surface of the paper to change to at one color distinguishable from the color of the playing surface where the liquid wets it. The image thus created can be used in the game or the paper can be folded to produce a relatively symmetrical image or twisted or rolled to produce a different kind of pattern. The image will probably never be perfectly symmetrical due to the random nature of the spread of the liquid and its adsorption into the paper. The paper is then unfolded, untwisted or unrolled to reveal the unique image created.

That image is then interpreted based upon suggested guidelines or guidelines created by the players. Such guidelines could include specifying a category of image interpretation, such as sports, famous people, historic events, animals. Another could be one player guessing what another player may see in the image. There are no winners or losers or fixed rules; the results are only limited by the imagination of the players. The surprising and unique effects of the game stimulates participation in all who play; thus the game can be used to "break the ice" of a social gathering and create an enlivened and yet relaxed atmosphere.

This game does not use inks or paints applied to paper by the participants, but rather employs a new use of chemical indicator technology to create surprising, unique, and novel images and human reactions. Remarkable color changes on the treated paper are created by common and relatively clear liquids to produce well defined and unique images in one or more colors. This encourages attention to the game and an eagerness to play. The game can be played using light-colored, dark-colored, clear, or colorless liquid, such as milk, water, white or red wine, beer, or another beverage. Another surprising and unexpected result is the eagerness of players to interpret the image that has been created. The game includes suggested subjects and ways to play the game and guidelines if the players wish to create their own basis for play.

Advantages

From the description above, a number of advantages of one or more embodiments of my image-creation game become evident:

(a) They provide an easily transportable, low cost, easy-to-understand and use game that can be played in almost any setting or social gathering including all age groups.

(b) Only the treated paper and a beverage are necessary to play the game. This is one of the most, if not the most, lightweight, low-cost and versatile social games created, thus making it utilitarian, unique and novel.

(c) Any color liquid, including clear, nearly clear and dark liquids may be used in the playing of the game.

(d) Though alcoholic beverages, such as wine and beer can be used to play the game this game does not encourage or necessitate the drinking of alcoholic beverages as do other games that involve such beverages.

(e) The images produced do not disappear when the liquid dries, thus a keepsake or hard-copy memory of the occasion is created as the game is played.

(f) There is no need to use a liquid dye, such as ink or paint to create the images.

(g) On the treated paper can include areas for players to record details of the event such as the names of the players, the beverage used, the location, date, time, the interpretations of the images, the guidelines by which the images were to be determined, etc., and thus document the occasion in the keepsake.

(h) The random application of the liquids and the possible folding or twisting of the paper will enable players to create unexpected, surprising and entertaining results because every image thus created is unique.

(i) The embodiments rely on the imagination of the players rather than on dice, cards, a playing board and luck, thus the players direct the game, rather than the game directing them. This also makes this a unique and novel game.

(j) The embodiments are easy to learn, understand and play, unlike prior art games that have intricate rules to learn and follow.

(k) They fuel the creative instincts of the players and can produce unusually humorous and interesting discussions.

(l) There need not be winners or losers and thus it can encourage positive rather than negative feelings during and after the playing of the game.

(m) There need not be winners or losers so that cooperation and relaxed engagement can be encouraged rather than competitive engagement.

(n) The colors produced by the treated paper produce surprising results especially when a colorless or mild-colored liquid is used.

(o) The playing of the game is not limited by rules and players can create their own rules and categories of interpretation. This makes the game specifically enjoyable to each group of players. The players can manipulate the game to their preferences rather than having to abide by a game's set rules and regulations.

(p) It is a unique and new use of chemical reactions to commonly consumed beverages that has heretofore not been applied to games.

Further advantages of one or more aspects will become apparent from a consideration of the ensuing description and accompanying drawings.

DRAWINGS

Figure 4:
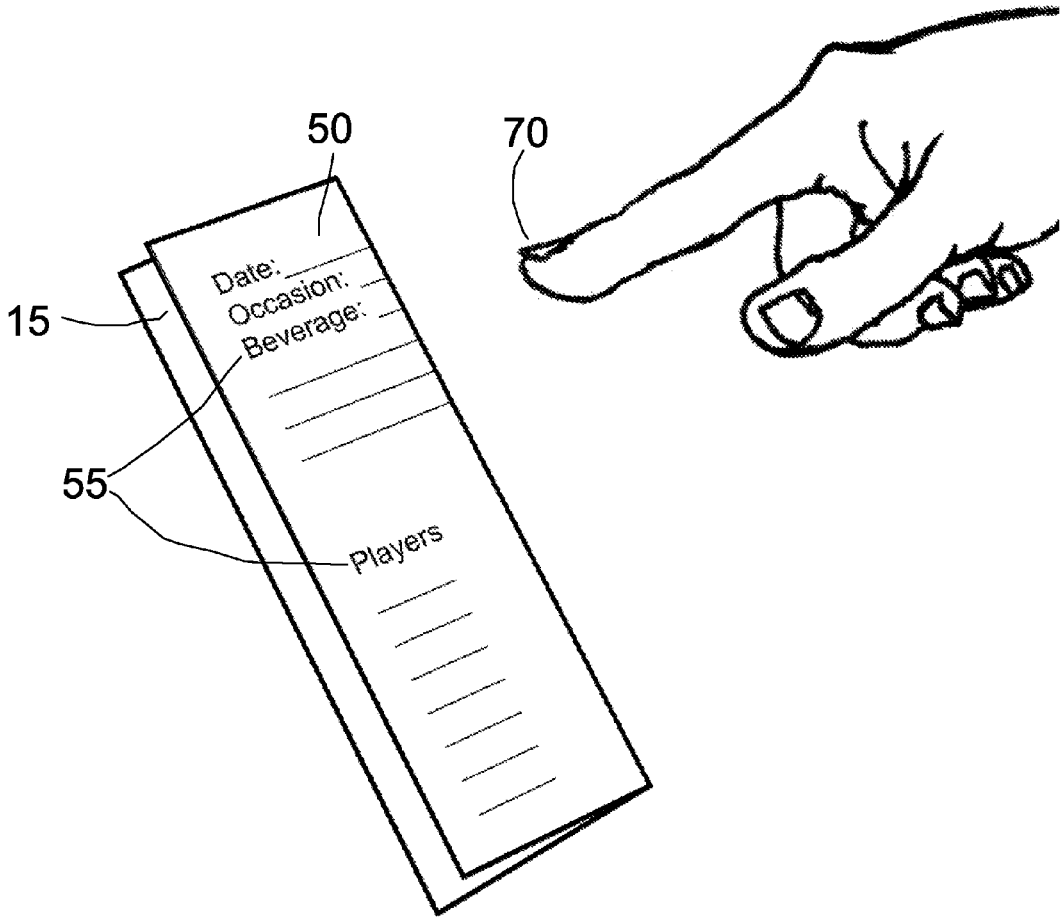

FIG. 4 shows the specially treated medium being folded. Note that it need not be folded at right angles to any edge. The folding of the paper at different angles can create different final images. The folded paper can be pressed by a finger to spread the liquid on the playing surface.

Figure 5:
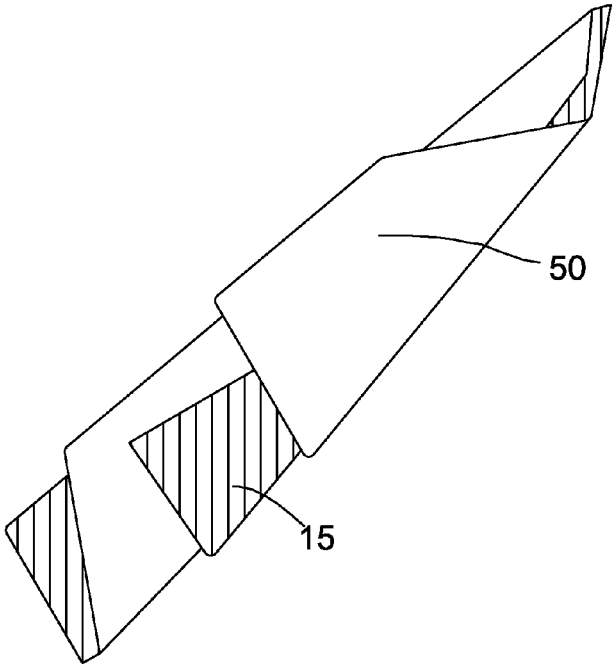

FIG. 5 shows the specially treated medium being twisted with the playing side towards itself.

Figure 6:
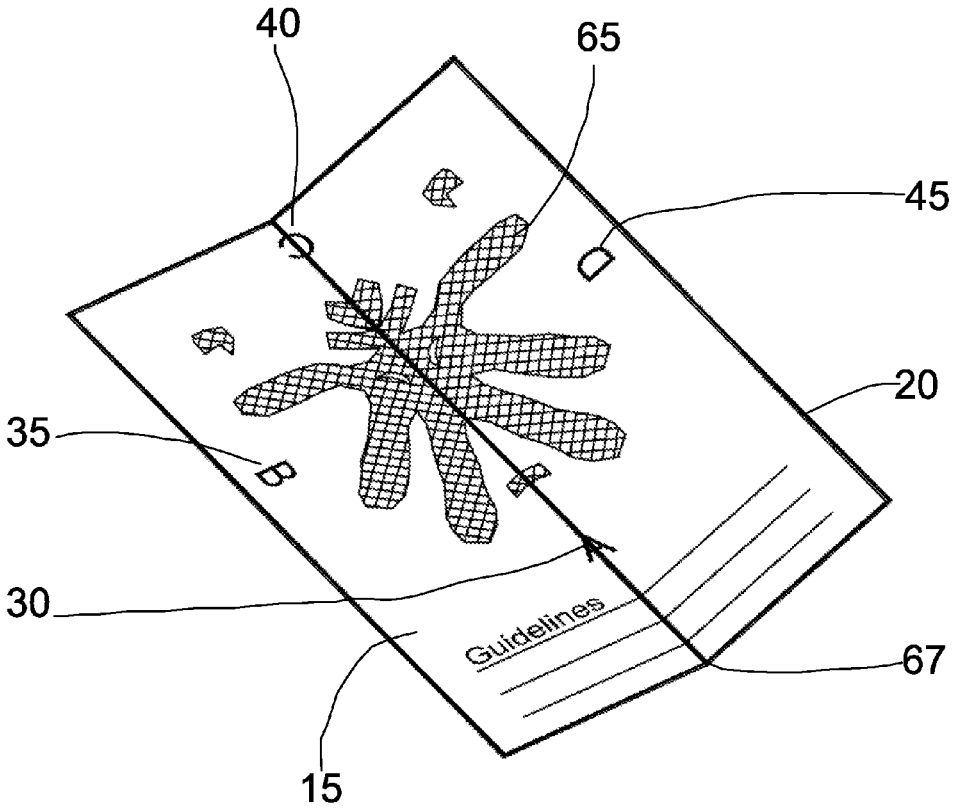

FIG. 6 shows the paper unfolded with the resulting image from the application of the liquid and folding.

Figure 7:
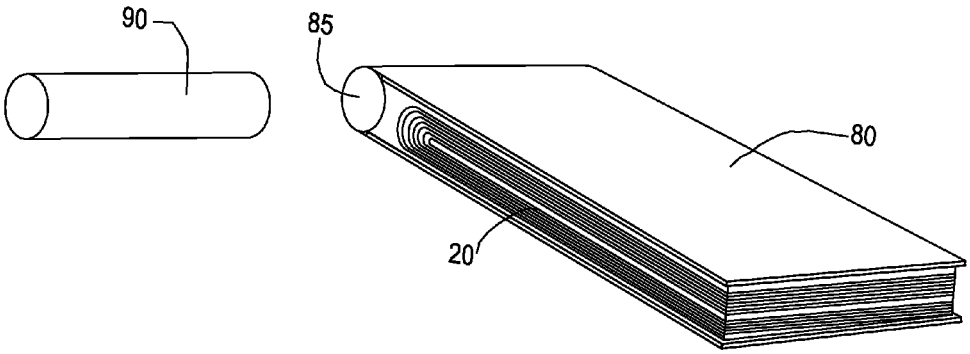

FIG. 7 shows the packaged game with liquid dispensing unit.

DRAWINGS

Reference Numerals

15—Playing surface of medium
20—Chemically treated medium
25—Area to record guidelines for game being played
30, 35, 40, 45—Reference points from which to view the resulting image
50—Reverse side of medium
55—Area for information to document the playing of the game
60—Liquid/beverage used to create the image
63—Partially absorbed liquid.
65—Created Image
67—Crease line
70—Finger
80—Folded game package
85—Compartment or clip for holding straw or eye dropper
90—Straw

DETAILED DESCRIPTION

Figure 1:
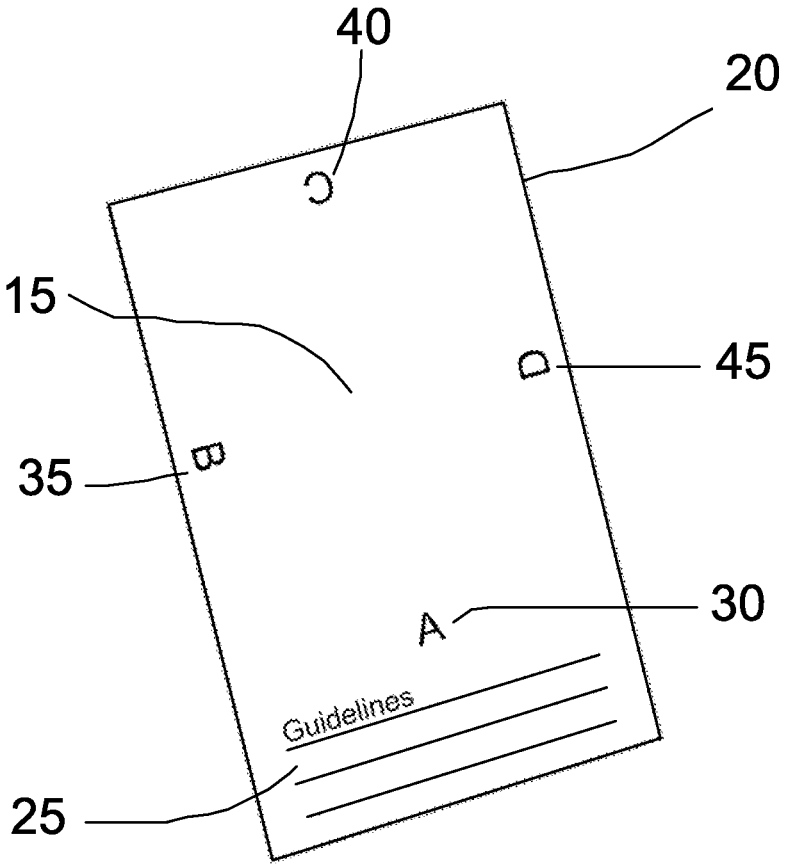
FIG. 1 shows a view of the playing side of a piece of specially treated medium.

FIG. 1—Playing Surface of Treated Medium

One embodiment is illustrated in FIG. 1, which shows the playing side 15 of a sheet of a medium (paper, cardboard, plastic, metal) 20 that has been treated with at least one reactive compound. Playing side 15 may be printed with areas 25 where information agreed to by the players, such as the guidelines by which the game is played, can be recorded. Various sides or areas of medium 20 can be marked with numerals or letters 30, 35, 40, 45 to reference the angle from which a player is viewing the image.

Medium 20 can be treated with at least one of many reactive compounds, such as bromophenol blue or methyl violet, as well as other compounds, such as cobalt chloride, that will effect a permanent color change upon exposure to nearly any common beverage. A pH indicator, such as neutral red will also change color when wetted by nearly any beverage, especially if were elevated to a pH of about 10 by addition of sodium hydroxide before being applied to medium 20. The application of a liquid to medium 20 may cause a light image to appear on a dark medium 20 or produce a dark image on a light medium 20, as desired. This embodiment merely needs to have a significant change of color to succeed in its aim and novelty. If medium 20 is a liquid-impermeable material, such as plastic or metal, it may be coated with a layer of a liquid-permeable material, such as paper or a permeable paint so that it will be semi-absorbent to be able to absorb liquid 60 being applied to it.

An example of one reaction that will induce a color change is treating paper with a hydrated cobalt chloride solution and then drying it in an oven. This causes the paper to be blue until moisture is applied, whereupon the wetted areas turn pink or white. This reaction is commonly used by moisture-sensing paper as sold by SK Science Kit and Boreal Laboratory in Tonawanda, N.Y.

Such moisture sensitive paper can be made by dissolving 5 grams of cobalt chloride hydrate ($CoCl_2.6H_2O$) in distilled water to make 100 ml of solution. This solution is sprayed onto playing surface 15 of medium 20, which in this case would probably be semi-absorbent white paper. The sheet is then dried in a warm oven at about 105° C. until the sheet has a blue tint. Though cobalt chloride has been classified as toxic, a 150-pound person would have to ingest over 1000 playing sheets to reach a level found to be dangerous in laboratory tests (Example: MSDS sheet on Cobalt Chloride by Sigma-Aldrich in St. Louis, Mo.). The negative effects from eating one-third this amount, which would be about pound and a half of paper, should discourage or prevent someone from ingesting a harmful amount.

Chemistry: $CoCl_2$ (light blue when dry)+
$6H_2O$<===>$CoCl_2.6H_2O$ (pink when hydrated)

Applying a reactive compound such as bromophenol blue, methyl blue, or any other dry powder dye to the playing side 15 of medium 20 can be accomplished by combining the powdered dye with an inert conveying material such as corn starch or other suitable organic or inorganic powders, such as talc, clays, or cellulose. The resulting mixture is then dry rubbed into the surface of the playing side 15 of medium 20. The excess mixture is then removed and the treated medium 20 is stored in moisture proof packaging until use.

Another application method for dry dye powder is to use the xerography process to apply a mixture of the dry reactive compound with variously compatible xerography toners and applying it to the playing side 15 of medium 20 as disclosed in my copending application Ser. No. 13/590,727, filed 2012 Aug. 21.

To obtain a reaction with the sulfite content of wine, a color changing reactant such as iodine with a starch indicator can be employed to treat playing side 15 of medium 20. The Ripper method, also known as iodine titration, for determining the sulfite content in wine may be modified using a paper medium with the starch indicator included to qualitatively detect the presence of sulfites by a color change.

To create the necessary solution for the iodine and starch treatment solution, Lugol's iodine, also known as Lugol's s solution, of a 5% concentration may be utilized. This can be created by combining 50 grams of solid iodine ($I_2$) and 500 grams of potassium iodide (KI) in 250 milliliters of distilled water and shaking well. Iodine is not readily soluble in water so there will still be solid iodine present at this point.

Separately, add 10.00 grams of corn starch to 1.00 liter of cold distilled water and stir to wet and to completely disburse the solids. Lightly boil the starch and water for 10 minutes with agitation and then cool the mixture. Once cool, add the boiled starch solution to the above iodine and potassium iodide solution to make up 1.00 liter of total solution. Agitate well and frequently over 24 hours to allow all the solid iodine to go into solution. Store the solution in a light proof brown bottle.

The resulting solution will be black with the starch grains carrying the complexed iodine. This solution is applied to the playing side 15 of medium 20 and the sheet is dried in an oven at 105° C. Store the resulting paper in light-proof packaging. The resulting playing surface 15 of medium 20 will be colored black. When wine or any other liquid containing sulfites or any other reducing chemical, is applied, the resulting image will appear as the original color of the medium 20. In the case of paper, it will probably be white.

The black solids in the iodine/starch system may not readily produce a uniform dispersion on a paper sheet when it is either applied by spraying with or dipping into the solution, then dried. Other application methods to obtain a more uniform dispersion include vacuum table setting, offset rolling, blade doctoring or de-watering the solution and spraying the solids onto medium 20.

Chemistry: $I_2$+KI (Black with starch indicator)+ $M_2SO_3$ (wine)+$H_2O$→KI+2MI+$H_2SO_4$ (Colorless with starch indicator)

"M" in the above reaction represents the general mixture of trace metal ions in wine that are associated with the wine's sulfite $SO_2^{-2}$. These trace metals may be potassium, sodium, calcium, magnesium and others in varying presence from the natural grapes. Including "M" in the equation is necessary to balance all the charges.

In another example a dry bleaching agent, such as sodium percarbonate (NacOCO3), borax ($Na_2B_4O_7.10H_2O$), or sodium dithionite ($Na_2S_2O_4$) can be applied to deeply colored, commercially available paper so that when a liquid is applied to playing side 15 of medium 20, the bleaching agent is activated to bleach the color dye out of the paper in the wet area. The activated area now contrasts with the surrounding dry, deeply colored area.

Finely powdered sodium percarbonate ($Na_2OCO_3$) is dry rubbed into playing side 15 of medium 20, such as a sheet of Wausau Astrobrights colored paper until the sheet's pores retain some measure of the bleaching agent. The excess is then removed. The sheet should be stored in a moisture and light proof package until use.

Chemistry: $Na_2OCO_3$+$H_2O$→$NA_2CO_3$+$H_2O_2$

The resulting hydrogen peroxide ($H_2O_2$) bleaches the colored dye or pigment in the colored paper, resulting in a white paper area in the playing side 15 of medium 20.

Many pH indicators may be employed, both laboratory pH indicator reagents such as Neutral Red, Phenolphthalein, Thymolphthalein, Methyl Green, or Methyl Violet, or natural indicators such a Red Cabbage extract or Turmeric Curcumin. If a specific beverage is targeted, other indicators with end points closer to the specific beverage's pH may be selected.

As an example, Neutral Red (3-Amino-7-dimethylamino-2-methylphenazine hydrochloride), also known as toluoylene red, indicator dye in ethanol elevated to a pH of 10.0 or higher by the addition of sodium hydroxide (NaOH) solution will be yellow. The solution is applied to playing surface 15 of medium 20 and dried, when any beverage with a pH below approximately 6.8 is applied, the resulting area will turn red.

To create the necessary solution, 0.75 gram of Neutral Red dye powder is mixed with 50 milliliters of warm ethanol and strongly agitated until all the powder is dissolved. It may be necessary to let the solution sit for an extended period to allow all the solid particles to dissolve.

Then 0.10 molar sodium hydroxide (NaOH) solution is titrated into the above solution until the pH is measured with a digital meter to be 10.0 or greater, and completely yellow. The resulting solution is applied to the playing side 15 of medium 20 and air dried.

Chemistry: HX (various acid species in beverages)+ NaOH+Neutral Red (yellow form)→NaX (sodium salts of the acids)+H2O+Neutral Red (red form)

Here X represents various inorganic negative ions such as chlorine, nitrate, or sulfate, or various organic negative ions such as acetate, citrate, oxalate, ascorbate, or phenoxides naturally found in common beverages.

By applying more than one reactive chemical to playing surface 15 or applying different reactive chemicals in different areas on playing surface 15 many different colors could be produced when liquid 60 contacts and is absorbed into playing surface 15. This can be done by masking an area of playing surface 15 while applying one reactive chemical and then masking the treated area while applying the second reactive chemical. Masking an area to prevent a reactive chemical from being applied and be done with a covering, such as masking tape or with a template with holes where the reactive chemical is to contact medium 20. Wet reactive chemicals can be applied in different areas as printers apply different colors to different areas on a printed page. The paper is passed through a printing machine several times in sequence. Each time a different area of the printing drum is masked in the areas already coated and to be coated and wetted in the area that will mate with the area of the paper to be receiving that particular reactive chemical. They could also be painted onto medium 20 using a template with holes or using freehand painting.

Figure 2:
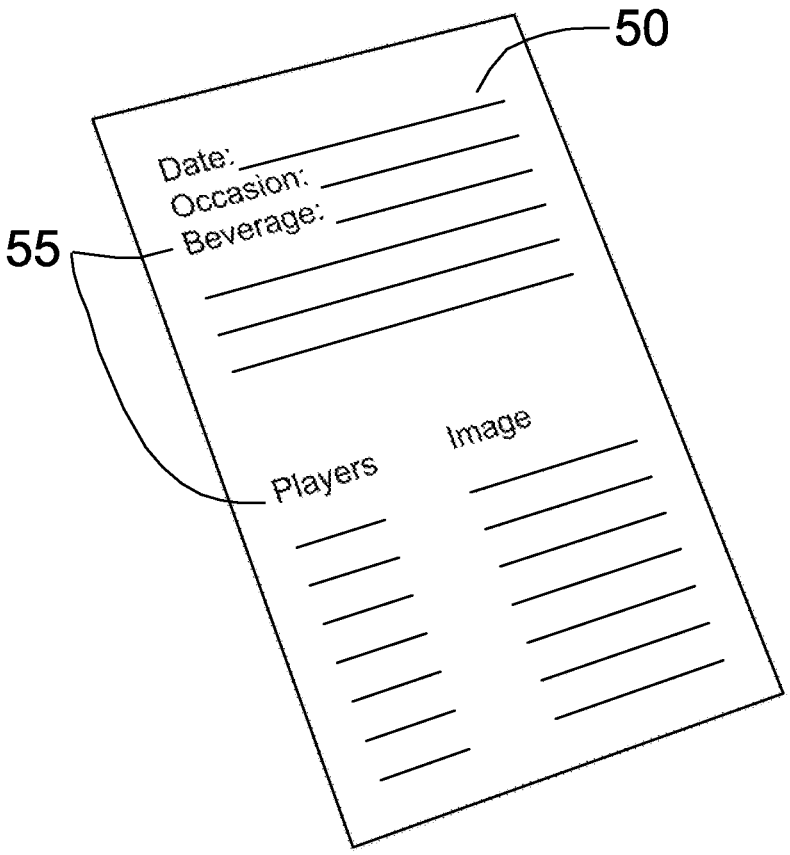
FIG. 2 shows a view of the reverse side of a piece of specially treated medium with areas for information.

FIG. 2—Reverse Side of Playing Surface

The reverse side 50 (FIG. 2) of medium 20 can be used to record information 55 related to the playing of the game. This may include instructions, the occasion, the date, location, the details of the beverage used, player names and their interpretations of the image. With information 55 recorded, medium 20 will create a keepsake of the occasion for the players.

Figure 3:
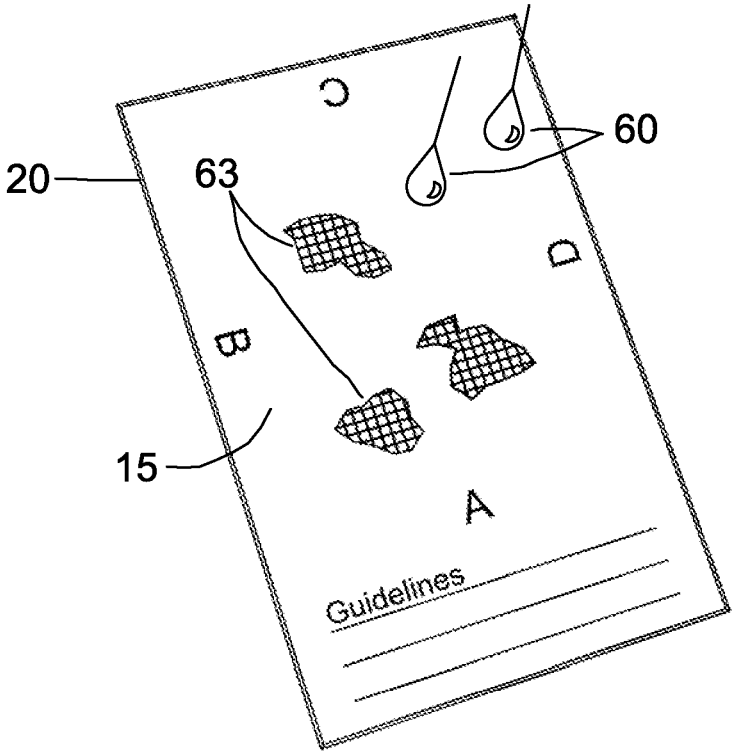
FIG. 3 shows droplets of liquid applied to the playing surface.

FIG. 3—Liquid Applied onto Treated Medium

FIG. 3 illustrates liquid 60 being applied randomly to parts of playing surface 15 of medium 20. Liquid 60 contacts parts of playing surface 15 of medium 20 and is partially absorbed. Liquid 60 may be applied to medium 20 in many ways, such as from an eye dropper, or a straw in which liquid was captured and held by placing a finger over the upward open end and then removing the finger to release liquid 60 or by simply wetting of fingers and flicking droplets of liquid 60 onto medium 20. A writing or drawing instrument need not be used to produce random application of liquid 60 onto medium 20. The applied droplets 60 change the color on the parts of playing surface 15 where the liquid is applied, as indicated by blots 63 on playing surface 15. I.e., the parts of surface 15 that are wet by liquid 60 will have a color that is different from and contrasts to the rest of surface 15 that liquid 60 does not wet, as shown in FIGS. 3 and 6. Any excess liquid 60 that has not been absorbed into playing side 15 can be spread onto other areas of the playing surface by folding or twisting playing surface 15 onto itself, as shown in FIG. 6.

The liquid applied can be a commonly consumed beverage being shared by the players. Such beverages can include everything from water to wine, depending upon the reactive chemical or chemicals applied to playing side 15. Beverages such as beer, white wine, milk, soft drinks, or alcoholic beverages can be used.

FIG. 4—Folding of Treated Medium to Spread Liquid

As indicated in FIG. 4, after activation medium 20 can be folded at least once to enhance the spreading of liquid 60 at least partially over playing surface 15. Medium 20 is shown folded with the fold vertical but the fold can be horizontal or at any diagonal angle to produce a result. The medium can be folded multiple times if desired by a player. The medium can alternatively be twisted (see next section) to form a pattern that folding would not. These options increase a player's ability to experiment in producing results. Pressure can be applied to enhance the spreading and absorbance of liquid 60 into the medium by rubbing a finger 70 of a player over reverse surface 50.

FIG. 5—Twisting of Treated Medium to Spread Liquid

FIG. 5 shows medium 20 with playing side 15 twisted towards itself to enhance the spreading of liquid 60 at least partially over playing surface 15. Twisting spreads liquid 60 over playing surface 15 in a different manner than folding playing side 15 onto itself as shown in FIG. 4 and thus can be used an alternate method of playing the game.

FIG. 6—Resulting Image

FIG. 6 shows a possible image 65 that may result after unfolding medium 20 and viewing how liquid 60 spread across and absorbed into the treated playing surface 15. When viewed from reference point 30, image 65 may appear to be a super hero in a cape with lightning bolts shooting outward. When viewed from reference point 35, image 65 may appear to be a crawling insect. When viewed from reference point 40, image 65 may appear to be the face of a dragon with long horns and ears.

Playing the Game

Playing the game can be done in many ways. In one example the host at a party greets a group of guests who have been recently introduced to each other and suggests that they play the game, which may be called "What I See". The host produces a treated sheet and explains how the game works, specifically that the sheet is treated to turn a different color in one or more areas that are wet with an activating solution, such as wine. The host explains that the wetted areas will turn a different color and the pattern or image will be interpreted by each player.

Examples of Guidelines for Games:

1. In one example one of the players wets the playing surface 15 of medium 20 with activating liquid 60 by spraying, splashing, dropping the liquid, etc. Medium 20 is folded to spread the liquid, unfolded and then each player reveals what they see as the resulting image on the playing surface and from what reference point 30, 35, 40, 45 they see the image.

2. In another example the game proceeds as in Example 1 except that the players agree to restrict the interpretation of resulting image 65 to a specific class or genus, such as insects, machines, sports, personalities, etc. The players must interpret or imagine what the resultant image 65 is within the stated restriction.

3. In another example each player is matched with at least partner by agreed pairing or by random selection such as drawing lots. After image 65 is created, each player secretly writes what they imagine what their partner or partners will see in the image. After each player does this, the answers are revealed and discussed.

The guidelines of the game being played are written on playing side 15 in an area 25 designated for that so there is no mistaking under what guidelines the game is being played. The interpretations of each player can be recorded in secret to be revealed after the game is finished or directly on reverse side 50 of medium 20 along with other details of the event in an area 55 created for that information.

FIG. 7—Packaged Game with Liquid Dispensing Unit

The game apparatus may be packaged in many ways. FIG. 7 shows one such way where medium 20 is packaged in a foldable cover 80. The cover also includes a means, such as a pocket or clip 85, to hold a liquid dispensing unit such as a straw or an eye dropper or a pen used to record data on medium 20 so the complete game is made easy to package, transport, maintain, and use.

CONCLUSIONS, RAMIFICATIONS AND SCOPE

Accordingly the reader will see that the treated paper image-producing system in various aspects, has one or more advantages:

- The game is lightweight, easy to learn and play.
- The creation of a bold image that contrasts to the surface of the playing medium by the application of a nearly colorless liquid is surprising and encourages play of the game.
- The image remains after the liquid has dried and so the game sheet can become a keepsake for players.
- A variety of beverages could be used to play the game.
- There is no need for players to use a colored liquid dye, such as ink or paint to create the images.
- There need not be winners or losers and thus it can encourage positive rather than negative feelings during and after the playing of the game.
- There need not be winners or losers so that cooperation and relaxed engagement can be encouraged over competitive engagement.
- This game provides an advance in the state of the art in that there are no tokens, playing boards, dice or cards needed to play the game.
- There are no particular containers, lights, crayons, boards or chemicals needed other than the beverages being enjoyed. Everything else is contained within and on the treated paper.
- Though alcoholic beverages, such as wine and beer can be used to play the game this game does not encourage or necessitate the drinking of alcoholic beverages as do other games that involve such beverages.
- There are many ways to play the game and thus it is infinitely flexible and can be altered to fit any social situation.
- The game is played until the players decide it is over. There is no need to stop or to continue playing based upon rules of completion.
- The game uses reactive chemicals on paper in a unique application.

Thus it is seen that the various embodiments provide a game with one or more of the following advantages: novelty, light in weight, economical, highly reliable, easily understood, and playable by persons of nearly any age with a no prior knowledge of such games. The various embodiments have the capacity to create introductions and improve interactions of people who may not interrelate easily.

While the above description contains many specifics, these should not be construed as limiting the scope of the embodiments, but as merely providing illustrations of some of several embodiments. For example, the paper or media can be cut in different shapes and forms such as circular or with punched holes to be stored in a binder. In lieu of a beverage, any other liquid may be applied to the treated medium. E.g., any body fluid, tap water, bottled water, a cosmetic liquid, etc. may be applied.

Those skilled in the art will envision many other possible variations are within its scope. Accordingly the reader is requested to determine the scope by the appended claims and their legal equivalents, rather than by the examples given.

The invention claimed is:

1. A method of playing a game, comprising:

a. providing an absorbent medium having opposite sides treated on at least one side with at least one reactive chemical that will significantly change to at least one color distinguishable from the color of said medium upon receiving a quantity of a predetermined beverage, and b. applying said predetermined beverage onto at least one part of one side of said medium so that said predetermined beverage wets said at least one part of said medium so as to cause said at least one part of said one side of said medium to change color where said predetermined beverage contacts said reactive chemical in said medium on said at least one part of said one side of said medium so as to change said medium where it is wetted by said predetermined beverage to said at least one color that is distinguishable from the color of said medium and that will not disappear after said predetermined beverage dries, c. folding or twisting said medium at least once to spread said predetermined beverage and thus create a relatively symmetrical lasting image as said predetermined beverage causes said at least one part of one side of said medium to change to said at least one color distinguishable from the color of said medium, and d. unfolding said medium to reveal said relatively symmetrical image, whereby a unique relatively symmetrical image will be created on said at least one part of said medium.

2. The method of claim 1 where said medium is paper.

3. The method of claim 1 where said reactive chemical is selected from the group consisting of bromophenol blue, methyl violet, cobalt chloride, and a pH indicator.

4. The method of claim 1, further including providing a liquid dispensing unit and means for packaging said medium and said liquid dispensing unit.

5. The method of claim 1, further including providing guidelines for interpreting said relatively symmetrical image.

6. The method of claim 1 wherein said beverage is selected from the group consisting of a light-colored liquid, a dark-colored liquid, clear liquid, a colorless liquid, milk, water, white wine, red wine, and beer.

7. A method of playing a game, comprising:

a. providing an absorbent foldable or twistable medium having opposite sides and treated on at least one side with at least one reactive chemical that will significantly change to at least one color distinguishable from the color of said medium upon contact with a predetermined liquid, b. applying said predetermined liquid onto at least one part of said one side of said medium so that said predetermined liquid wets said at least one part of said medium so as to cause at least one color change on said at least one part of said one side of said medium where said predetermined liquid contacts said reactive chemical in said medium, where said color change (a) is different from and contrasts with the color on the rest of said one side of said medium, and (b) will not disappear after said beverage dries, c. folding or twisting said medium at least once to spread said predetermined liquid over said at least one part of said medium, further contacting said reactive chemical and thus creating a relatively symmetrical lasting image as said predetermined liquid causes said at least one color change, and d. unfolding said medium to reveal said relatively symmetrical image, whereby a unique relatively symmetrical image will be created on said at least one part of said medium.

8. The method of claim 7 where said predetermined liquid is a beverage.

9. The method of claim 8 where said medium is paper.

10. The method of claim 8 where said reactive chemical is selected from a group consisting of bromophenol blue, methyl violet, cobalt chloride, and a pH indicator.

11. The method of claim 8, further including providing a liquid dispensing unit and means for packaging said medium and said liquid dispensing unit.

12. The method of claim 8, further including providing guidelines for interpreting said relatively symmetrical image.

13. A method of playing a game between at least two players, comprising:

a. providing an absorbent foldable or twistable medium having opposite sides and treated on at least one side with at least one reactive chemical that will significantly change to at least one color distinguishable from the color of said medium upon contact with a beverage, b. applying said beverage onto at least one part of one side of said medium so as to cause at least one color change in said at least one part of medium where said beverage contacts said reactive chemical and that will not disappear after said beverage dries, c. folding or twisting said medium at least once to spread said beverage over said at least one part of said medium, further contacting said reactive chemical and thus creating a relatively symmetrical lasting image as said beverage causes said at least one color change, d. unfolding said medium to reveal said relatively symmetrical image, whereby a unique relatively symmetrical image will be created on said at least one part of said medium.

14. The method of claim 13, further including examining said relatively symmetrical image and stating what said players see in said relatively symmetrical image.

15. The method of claim 13 wherein said beverage is selected from the group consisting of a alcoholic and non-alcoholic liquids.

16. The method of claim 13 where said medium is paper.

17. The method of claim 13 where said reactive chemical is selected from a group consisting of bromophenol blue, methyl violet, cobalt chloride, and a pH indicator.

18. The method of claim 13, further including providing a liquid dispensing unit and means for packaging said medium and said liquid dispensing unit.

19. The method of claim 13, further including providing guidelines for interpreting said relatively symmetrical image.

* * * * *